US005390571A

United States Patent [19]

Fox, III et al.

[11] Patent Number: 5,390,571

[45] Date of Patent: Feb. 21, 1995

[54] PUSH BUTTON SOCKET LOCKING MECHANISM

[76] Inventors: Leonard J. Fox, III, 1920 College Blvd. #278, Oceanside, Calif. 92056; Bruce A. Heckbert, 120 Tampa St., West Warwick, R.I. 02893

[21] Appl. No.: 26,828

[22] Filed: Mar. 5, 1993

[51] Int. Cl.[6] ..... B25B 13/00

[52] U.S. Cl. ..... 81/177.85; 403/325; 403/328

[58] Field of Search ..... 81/177.85; 403/322, 403/324, 325, 328

[56] References Cited

U.S. PATENT DOCUMENTS

| | | | |
|---|---|---|---|
| 1,864,466 | 9/1930 | Peterson . | |
| 2,009,371 | 7/1935 | Junge | 403/328 |
| 2,162,359 | 6/1939 | Rhinevault | 287/119 |
| 3,208,318 | 9/1965 | Roberts | 81/177 |
| 3,924,493 | 12/1975 | Penner | 81/177 G |
| 4,367,663 | 1/1983 | Merics | 81/177 A |
| 4,433,934 | 2/1984 | Cleveland | 403/325 X |
| 4,614,457 | 9/1986 | Sammon | 81/177.85 X |
| 4,781,085 | 11/1988 | Fox, III | 81/177.85 |
| 4,962,682 | 10/1990 | Rose et al. | 81/177.85 |

*Primary Examiner*—James G. Smith
*Attorney, Agent, or Firm*—Calif Tervo

[57] ABSTRACT

A shaft drive includes a push button locking mechanism for releasingly locking the shaft drive to the attachment cavity of an attached tool. The locking mechanism can be used to positively couple one tool, such as a wrench drive, to another tool, such as a drive socket. A push button includes an inner end having a concave surface that interacts with the convex surface of a sliding locking bolt inside the shaft such that depression of the button moves the locking bolt to a release position. A spring in the locking bolt bore biases the bolt in its locking position.

5 Claims, 1 Drawing Sheet

FIG. 1
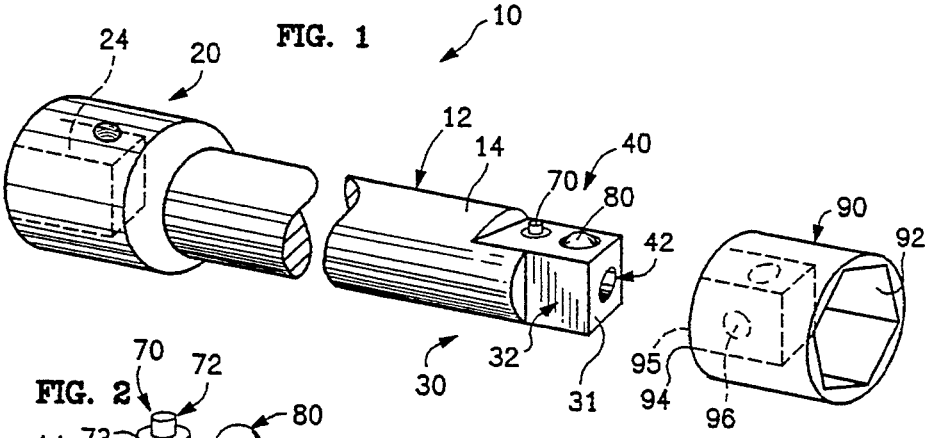
FIG. 2
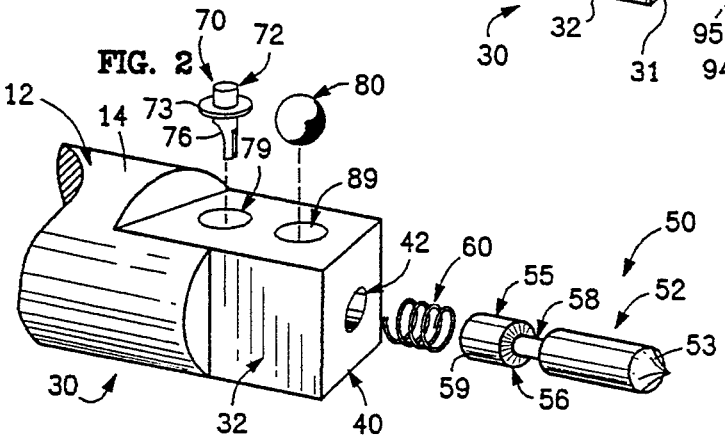
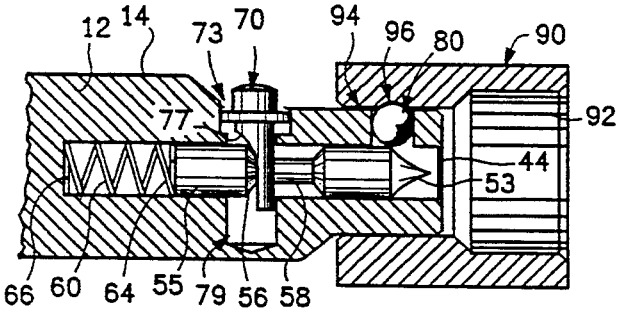
FIG. 5
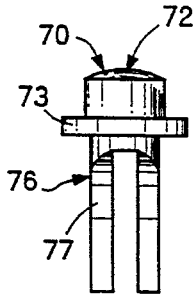
FIG. 3a
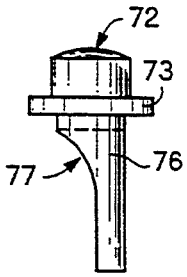
FIG. 3b
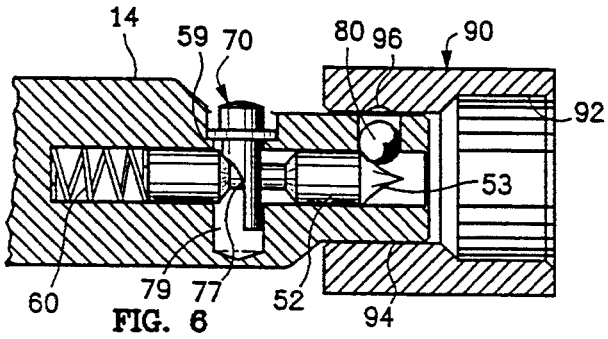
FIG. 6
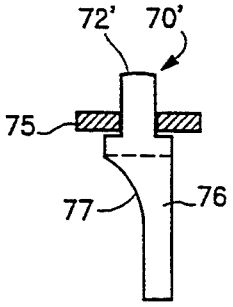
FIG. 4

PUSH BUTTON SOCKET LOCKING MECHANISM

BACKGROUND OF THE INVENTION

1. Field of the Invention

This invention relates, in general, to a locking mechanism for releasingly locking a shaft to a tool attachment cavity with the more specific implementation of use of releasingly locking a socket onto socket wrench shaft drive.

2. Background of the Invention

The desirability of some type of locking drive for a socket wrench system has long been recognized as a means to prevent the system components from uncoupling. For example, U.S. Pat. No. 4,480,511 of M. F. Nickipuck titled "Locking Socket Wrench Drive Device" describes a socket wrench extension having drive end that locks onto a socket, and U.S. Pat. No. 4,502,365 of K. M. Hacker titled "Socket Wrench Extension" also describes an extension with a releasing locking device on the drive. U.S. Pat. No. 4,781,085 titled "Locking Socket Wrench Extension" of current co-inventor L. Fox III describes another such device. U.S. Pat. No. 4,962,682 titled "Wrench Extension and Socket Coupler" to Rose et al. describes a push button locking device for a wrench extension.

The desirability of a locking ratchet drive is also seen in the prior art. U.S. Pat. No. 4,399,722 of V. Sardo titled "Socket Wrench Including Quick Release Adaptor" describes a ratchet drive including a mechanism for locking a socket to the drive head.

Due to the added complexity and expense of these devices, most ratchet drives sold do not contain a locking feature and the conventional locking devices suffer from one or more shortcomings. They are overly complex, expensive, difficult to assemble, difficult to use, or jam or do not work when subjected to a dirty environment.

In this regard, it is also desirable that any locking mechanism components do not protrude beyond the outer diameter of the shaft.

Therefore, there has been a need for a an improved locking mechanism for a shaft drive such that its addition to the drive does not noticeably alter the performance and handling of the ratchet driver.

SUMMARY OF THE INVENTION

This invention is a push button locking mechanism for releasingly locking a shaft drive to the attachment cavity of an attached tool. The locking mechanism can be used to positively couple one tool, such as a wrench drive, to another tool, such as a drive socket.

The locking mechanism includes a central bore within the shaft, a detent cavity extending radially from the central bore through the drive and a push-button cavity extending radially from the central bore through the shaft aft of the drive. A detent is disposed in the detent cavity and movable between a locking position wherein it protrudes out of the drive so as to engage the socket cavity and prevent its removal from the drive and a releasing position wherein it resides substantially within the drive so as not to engage the socket cavity.

A locking bolt within the central bore includes a front section engaged with the detent and a rear section including a convex surface for sliding engagement with a push button. The bolt is axially moveable such that as the bolt is moved from a release position to a locking position, its front section moves the detent from its release position to its locking position. A spring in the central bore biases the bolt in its locking position.

A push button in the push-button cavity has an inner end including a concave surface for sliding engagement with the bolt convex surface. The push button is radially moveable such that the bolt in the locking position biases the button outward such that the button protrudes from the shaft and such that depression of the button outer end moves the locking bolt to the release position.

Other features and many attendant advantages of the invention will become more apparent upon a reading of the following detailed description together with the drawings in which like reference numerals refer to like parts throughout.

BRIEF DESCRIPTION THE DRAWING

FIG. 1 is a perspective view, partially broken away, of a preferred embodiment of the locking shaft of the present invention in the form of a socket wrench extension shaft along with a typical attachment socket.

FIG. 2 is an enlarged exploded perspective view of the shaft and locking mechanism of FIG. 1.

FIG. 3*a* and FIG. 3*b* are enlarged views of the push button of FIG. 2. FIG. 3*a* is a rear view, FIG. 3*b* is a left side view.

FIG. 4 is a side view similar to FIG. 3*b* but of an alternate embodiment of a button 70′.

FIG. 5 is a vertical cross-sectional view of the shaft of FIG. 1 with the locking mechanism locked onto an attached socket.

FIG. 6 is a vertical cross-sectional view of the shaft of FIG. 1 with the locking mechanism in the release position.

DETAILED DESCRIPTION OF THE INVENTION

With reference now to the drawings, and more particularly to FIG. 1 thereof, there is shown a perspective view, partially broken away, of a preferred embodiment of the locking shaft of the present invention in the form of a socket wrench extension shaft, denoted generally as 10, along with a typical attachment socket wrench 90.

Socket wrench 90 is representative of the common type having a fastener engaging socket 92 on its front end for engaging a bolt head or a nut and having an attachment cavity or socket, denoted generally as 94 and shown in phantom, for attachment of a torque-transferring shaft for turning socket wrench 90. Typically, attachment socket 94 includes a small depression 96, shown in phantom, on each inside wall 95.

Although a socket wrench extension shaft 10 is shown and described, it can be seen that the locking shaft of the invention may be used to lock any similar shaft 10 to a cavity 94.

The elongated central shaft portion 12 of shaft 10 is circular in cross-section and includes outer surface 14. Locking shaft 10 has rear end, denoted generally as 20 and a front end, denoted generally as 30. Rear end 20 of locking shaft 10 includes coupling means, such as socket 24, shown in phantom, for coupling such as to a socket system drive. Shaft front end 30 includes receiving means, such as ⅜″ square drive, denoted generally as 32, for insertion into and torque-transferring engagement with wrench attachment cavity 94 and locking means, such as a locking mechanism, denoted generally as 40. Drive 32 is cut out of shaft 10.

The components of an exemplary embodiment of locking mechanism 40 are best seen in FIG. 2. FIG. 2 is an enlarged exploded perspective view of shaft 10 and locking mechanism 40 of FIG. 1. Shaft locking mechanism 40 generally includes: a central bore 42 that contains a locking bolt 50 and biasing means, such as spring 60; a push-button bore or cavity 79 housing a push button 70; and a detent bore or cavity 89 housing a detent, such as detent ball 80. Push button bore 79 is located aft of drive 32. Detent bore 89 extends radially from central bore 42 through drive 32. As best seen in FIG. 4, central bore 42 is formed, typically by drilling, into shaft 10 from front face 31. Push button bore 79 is formed typically by drilling to pass through central bore 42. Detent bore 89 is typically formed by drilling to unite with central bore 42.

Locking bolt 50 is inserted into central bore 42 and can move axially in the bore 42. Locking bolt 50 includes a front section 52 and a rear section 55. In the embodiment shown, bolt front section 52 includes a slide portion, such as conical tip 53, for moving detent ball 80 from the unlocked to the locked position. In the preferred embodiment shown, the sides of conical tip 53 are slightly concave such that only slight movement is needed to move detent ball 80 from the locked to the unlock position. Bolt 50 includes button engaging means, such as fore-facing convex shoulder 56, for sliding engagement with button 70. Button guide means, such as diminished diameter portion 58, stabilizes and guides movement of button 70. Rear end 59 is adapted to engage spring 60.

FIG. 3*a* and FIG. 3*b* are enlarged views of push button 70 of FIG. 2. FIG. 3*a* is a rear view and FIG. 3*b* is a left side view of push button 70. Push button 70 basically includes an outer end 72, preferably in a form for depression by a user's digit such as the thumb, and an inner end 76. Button inner end 76 is disposed in bore 79 and includes bolt engaging means, such as aft-facing concave surface 77, for engaging the bolt's button engaging means 56. Means, such as button channel 78, receives the bolt's diminished diameter portion 58 for guiding and stabilizing button movement. In the preferred embodiment shown in FIG. 3*a* and 3*b*, button 70 includes means, such as expanded portion, such as shoulder or collar 73, for acting as a stop to button movement.

FIG. 4 is a side view similar to FIG. 3*b* but of an alternate embodiment of a button 70' illustrating an alternate embodiment for controlling button movement and retaining the button in bore 79. Button 70' includes a lower end 76' constructed in accordance with the principles of button 70. However, upper end 72' includes a reduced portion, such as push pin 74 for passing through retaining washer 75. In this configuration, washer 75 is retained, such as by press fit and crimping, in the outer end of button bore 79 to retain button 70' in bore 79 with push pin 74 accessible to a user for depressing the button 70'.

The working of the locking mechanism is best described with reference to FIGS. 5 and 6. FIG. 5 is a vertical cross-sectional view of the shaft of FIG. 1 with the locking mechanism locked onto an attached socket 90. FIG. 6 is a vertical cross-sectional view of the shaft of FIG. 1 with the locking mechanism in the release position.

In FIG. 5, detent ball 80, is disposed in and can move in radial cavity 89. The outer entrance of radial cavity 89 is crimped such that detent ball 80 can protrude but cannot exit therethrough.

Push button 70 is disposed in button bore 79 such that it can move axially to the bore. Collar 73 moves in counter bore 78 on the outer end of bore 79. Button 70 is prevented from further outward movement when collar 73 encounters retaining means, such as a restriction on the button bore 79, such as a surface crimp at the at the outer end of bore 79. Button 70 is restricted in inward movement when collar 73 encounters shoulder at the end of counter bore 78.

Biasing means, such as spring 60, includes a front end 64 that bears against locking bolt 50, such as against rear end 59 and a rear end that bears against the end of central bore 42. Spring 60 biases bolt 50 in the forward or locking position as seen in FIG. 5. The outer opening of central bore 42 may be fitted with a plug 44 to prevent dirt from entering the locking mechanism.

With locking mechanism 40, in the locking position shown in FIG. 5, the forward biased bolt tapered front section 53 raises detent ball 80 in radial cavity 89 until ball 80 protrudes sufficiently from drive 32 so as to engage depression 96 in socket attachment cavity 94 and prevent removal of socket 90 from drive 32. As seen in FIG. 5, in the fully locked position, detent ball 80 is supported by a flat outer diameter of bolt 50 such that force on detent ball 80 cannot force its retraction and such that detent ball 80 can only be retracted from the locking position by moving bolt 50 rearward.

Bolt convex shoulder 56 engages button convex face 77 such that the resulting force biases button 70 in the upward position in the locked position. Although the bolt/button engaging surfaces as shown and described are convex/concave in the preferred embodiment, slanted planar surface may be used to achieve the intended result that forward force of bolt 50 on button 70 biases button 70 in the raised position and that downward, i.e. radially inward, movement of button 70 moves bolt 50 rearward.

FIG. 6 is a vertical cross-sectional view of the shaft of FIG. 1 with the locking mechanism 40 in the release position. Locking mechanism 40 is moved to the unlock position shown by a downward force, such as depression by a user's thumb, on the outer end 72 of button 70 which moves button 70 inward whereby the engaging surface exerts a rearward force on bolt 50 sufficient to overcome the forward bias of spring 60 and further compressing spring 60. Bolt 50 moves rearward from its biased forward locking position to a releasing position wherein detent ball 80 retracts sufficiently into radial cavity 89 such that it no longer engages socket attachment cavity 94. In the embodiment shown, in releasing position, detent ball 80 resides partially in central bore 42.

To attach a socket, push button 70 is repressed and socket 90 is placed on drive 32. Upon release of push button 70, bias spring 60 moves bolt 50 forward to the locking position.

Having described the invention, it can be seen that it provides a very convenient device for releasingly locking a drive member to a socket.

Notably, in the configuration of the invention, push button 70 does not protrude above the outer surface 14 of elongate shaft portion 12.

Although particular embodiments of the invention have been illustrated and described, various changes may be made in the form, composition, construction, and arrangement of the parts without sacrificing any of its advantages. For example, although the locking mechanism has been illustrated and described as attaching a shaft to the socket of a socket wrench; the invention is not so limited and can be used to attach any shaft to any attachment cavity. Therefore, it is to be understood that all matter herein is to be interpreted and illustrative and not in any limiting sense and it is intended to cover in the appended claims such modifications as come within the true spirit and scope of the invention.

We claim:

1. A shaft for releasingly locked attachment to a tool having an attachment cavity; said shaft including:
- an elongated cylindrical portion having an outer surface; and a front end including:
  - receiving means adapted for insertion into the tool attachment cavity for attaching the tool;
- a central bore within said shaft;
- a detent cavity extending radially from said central bore through said receiving means;
- a push-button cavity extending radially from said central bore through a reduced radius portion of said shaft aft of said receiving means;
- a detent disposed in said detent cavity and movable between a locking position wherein it protrudes out of said receiving means so as to engage an attached tool attachment cavity and prevent its removal from said receiving means and a releasing position wherein it resides substantially within said receiving means so as not to engage an attached tool attachment socket;
- a locking bolt within said central bore including:
  - a front section engaged with said detent; and
  - a rear section including:
    - button engaging means for sliding engagement with a push button; said bolt being axially moveable such that as said bolt is moved from a release position to a locking position, its said front section moves said detent from its release position to its locking position;
- spring biasing means in said central bore for biasing said bolt in its locking position;
- a push button disposed in said push-button cavity; said push button having:
  - an outer end; and
  - an inner end including:
    - bolt engaging means for sliding engagement with said locking bolt button engaging means; said push button being radially moveable such that said bolt in the locking position biases said button radially outward such that said button outer end protrudes from said push-button cavity and such that depression of said button outer end moves said locking bolt to the release position; said push button outer end at all times being radially at or below said outer surface of said elongated cylindrical portion of said shaft.

2. The shaft of claim 1 wherein: said shaft includes:
- an elongated cylindrical portion having an outer surface;

and wherein
- said push button outer end is at all times radially at or below said outer surface of said elongated cylindrical portion of said shaft.

3. A shaft for releasingly locked attachment to a tool having an attachment cavity; said shaft including:
- a front end including:
  - receiving means adapted for insertion into the tool attachment cavity for attaching the tool; and
- a central bore within said shaft;
- a detent cavity extending radially from said central bore through said receiving means;
- a push-button cavity extending radially from said central bore through said shaft aft of said receiving means;
- a detent disposed in said detent cavity and movable between a locking position wherein it protrudes out of said receiving means so as to engage an attached tool attachment cavity and prevent its removal from said receiving means and a releasing position wherein it resides substantially within said receiving means so as not to engage an attached tool attachment socket;
- a locking bolt within said central bore including:
  - a front section engaged with said detent; and
  - a rear section including:
    - button engaging means for sliding engagement with a push button;
    - said bolt being axially moveable such that as said bolt is moved from a release position to a locking position, its said front section moves said detent from its release position to its locking position;
- spring biasing means in said central bore for biasing said bolt in its locking position;
- push button disposed in said push-button cavity; said push button having:
  - an outer end; and
  - an inner end including:.
    - bolt engaging means including: an aft-facing concave surface for sliding engagement with said locking bolt button engaging means; said push button being radially moveable such that said bolt in the locking position biases said button radially outward such that said button outer end protrudes from said shaft and such that depression of said button outer end moves said locking bolt to the release position; and wherein
- said locking bolt rear section button engaging means includes:
  - a fore-facing convex surface that engages said aft facing concave surface.

4. A shaft for releasingly locked attachment to a tool having an attachment cavity; said shaft including:
- a front end including:
  - receiving means adapted for insertion into the tool attachment cavity for attaching the tool;
- a central bore within said shaft;
- a detent cavity extending radially from said central bore through said receiving means;
- a push-button cavity extending radially from said central bore through said shaft aft of said receiving means;
- a detent disposed in said detent cavity and movable between a locking position wherein it protrudes out of said receiving means so as to engage an attached tool attachment cavity and prevent its removal from said receiving means and a releasing position wherein it resides substantially within said receiving means so as not to engage an attached tool attachment socket;
- a locking bolt within said central bore including:
  - a front section engaged with said detent; and
  - a rear section including:.

button engaging means for sliding engagement with a push button;

said bolt being axially moveable such that as said bolt is moved from a release position to a locking position, its said front section moves said detent from its release position to its locking position;

spring biasing means in said central bore for biasing said bolt in its locking position;

a push button disposed in said push-button cavity; said push button having:

an outer end; and an inner end including:

bolt engaging means for sliding engagement with said locking bolt button engaging means; said push button being radially moveable such that said bolt in the locking position biases said button radially outward such that said button outer end protrudes from said shaft and such that depression of said button outer end moves said locking bolt to the release position; and wherein:

said locking bolt front section includes a concave slide portion for moving said detent ball from the unlocked to the lock position.

5. A shaft for releasingly locked attachment to a tool having an attachment cavity; said shaft including:

a front end including:

receiving means adapted for insertion into the tool attachment cavity for attaching the tool; and a central bore within said shaft;

a detent cavity extending radially from said central bore through said receiving means;

a push-button cavity extending radially from said central bore through said shaft aft of said receiving means;

a detent disposed in said detent cavity and movable between a locking position wherein it protrudes out of said receiving means so as to engage an attached tool attachment cavity and prevent its removal from said receiving means and a releasing position wherein it resides substantially within said receiving means so as not to engage an attached tool attachment socket;

a locking bolt within said central bore including:

a front section engaged with said detent;

a rear section including:

button engaging means for sliding engagement with a push button;

said bolt being axially moveable such that as said bolt is moved from a release position to a locking position, its said front section moves said detent from its release position to its locking position; and a recessed diameter section between said bolt front section and said bolt rear section; said recessed diameter section having a smaller diameter than said bolt front section and said bolt rear section;

spring biasing means in said central bore for biasing said bolt in its locking position;

a push button disposed in said push-button cavity; said push button having:

an outer end; and an inner end including:

a button channel straddling said bolt recessed diameter section for guiding and stabilizing button movement; and bolt engaging means for sliding engagement with said locking bolt button engaging means; said push button being radially moveable such that said bolt in the locking position biases said button radially outward such that said button outer end protrudes from said shaft and such that depression of said button outer end moves said locking bolt to the release position.

* * * * *